US005425292A

United States Patent [19]

Mobile

[11] Patent Number: 5,425,292

[45] Date of Patent: Jun. 20, 1995

[54] WRENCH DEVICE

[76] Inventor: Raymond A. Mobile, 5 Woods Chapel Rd., Rolling Meadows, Ill. 60008

[21] Appl. No.: 126,579

[22] Filed: Sep. 24, 1993

[51] Int. Cl.[6] ..... B25B 13/00

[52] U.S. Cl. ..... 81/124.4; 81/125.1; 81/177.1

[58] Field of Search ..... 81/121.1, 124.3, 124.4, 81/125.1, 177.1

[56] References Cited

U.S. PATENT DOCUMENTS

D. 103,579 3/1937 McNaught ..... 81/124.3 X
D. 104,869 6/1937 McNaught .
D. 120,489 5/1940 Musselman .
D. 176,005 11/1955 Cariello .
D. 257,383 10/1980 Davenport .
1,072,479 9/1913 Martindale ..... 81/124.3
1,464,128 8/1923 Coes ..... 81/125.1 X
3,745,860 7/1973 Bennett .
5,062,327 11/1991 Hammons et al. .

*Primary Examiner*—James G. Smith
*Attorney, Agent, or Firm*—Welsh & Katz, Ltd.

[57] ABSTRACT

A wrench device includes an elongated body having laterally offset end portions each of which has a plurality of different size wrench openings therethrough and defines a hand gripping edge surface and a foot receiving edge surface, the wrench openings enabling cooperation with various size polygonal shaped screw heads, bolts and nuts to apply torque thereto.

8 Claims, 1 Drawing Sheet

WRENCH DEVICE

BACKGROUND OF THE INVENTION

The present invention relates generally to wrench devices, and more particularly to a novel relatively inexpensive wrench device adapted for use with a plurality of different size polygonal-shaped cap screws, bolts and nuts and which is configured to facilitate improved hand gripping and/or foot assisted torquing of the screws, bolts and nuts.

A problem common to all persons who have relatively infrequent need for a wrench to tighten or loosen a polygonal-head screw, bolt or nut is that such need generally arises when an appropriate fixed-size wrench, or an adjustable wrench, is not readily available. If one desires to be prepared at all times for any emergency requiring adjustment of a screw, bolt or nut, they must either maintain a tool box or other supply of tools at the location where such a problem may arise, or in a vehicle such as an automobile or truck. This entails substantial expense as well as taking up space that might be more efficiently used for other purposes.

Accordingly, a need exists for a relatively inexpensive single wrench device which facilitates use with a plurality of different size polygonal shaped screw heads, bolts and/or nuts and which enables the necessary torque to be applied through convenient hand gripping or foot assisted force application to the wrench.

SUMMARY OF THE INVENTION

One of the primary objects of the present invention is to provide a relatively inexpensive and highly efficient novel wrench device for use with a plurality of different size polygonal-shaped screw heads, bolts and nuts.

A more particular object of the present invention is to provide a novel wrench device which takes the form of a single readily manipulable tool for torquing polygonal-shaped screw heads, bolts and nuts of different sizes and which has opposite laterally offset end portions defining hand grips enabling manual manipulation of the wrench, and which also facilitate foot-assisted torquing.

A feature of the wrench device in accordance with the invention lies in the provision of a plurality of polygonal shaped openings through both opposite end portions of the wrench body, such openings being of polygonal configurations enabling use of the wrench with square, hex-head and/or octagonal shaped screw heads, bolts and nuts.

Another feature of the wrench device in accordance with the invention lies in the provision of polygonal shaped wrench openings which enable use of the wrench with both American and metric size screw heads, bolts and nuts.

Further objects and advantages of the invention will become apparent from the following detailed description of the invention when taken in conjunction with the accompanying drawing wherein like reference numerals designate like elements throughout the various views.

DETAILED DESCRIPTION

Figure 1:
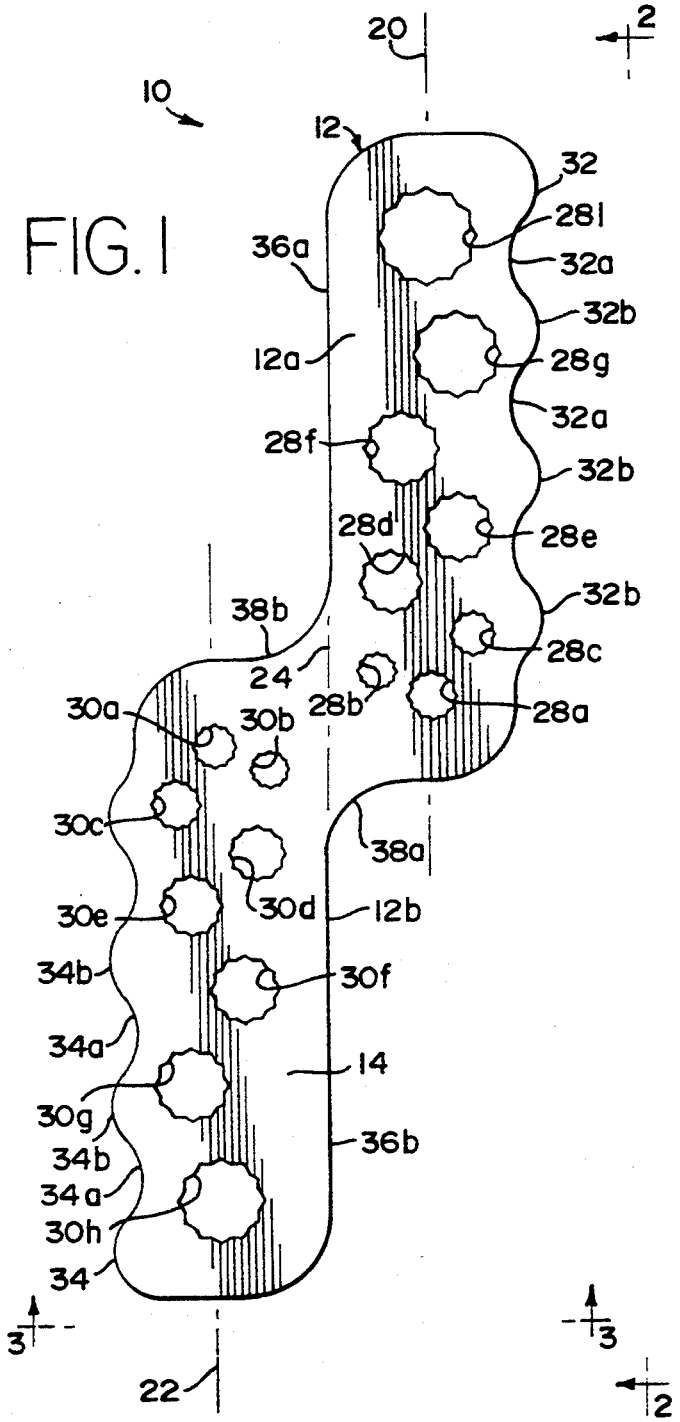
FIG. 1 is a plan view of a wrench device constructed in accordance with the present invention.
Figure 2:
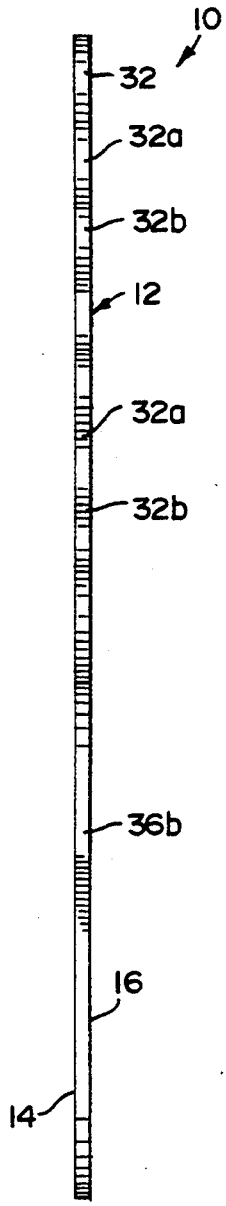
FIG. 2 is a side edge elevational view taken substantially along line 2—2 of FIG. 1.
Figure 3:
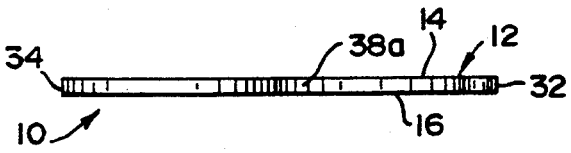
FIG. 3 is an end elevational view taken substantially along line 3—3 of FIG. 1.

Referring now to the drawing, a wrench device constructed in accordance with the present invention is indicated generally at 10. The wrench device includes an elongated body, indicated generally at 12, which is preferably made from a suitable strength metallic material, such as T1075 steel heat treated to a hardness of approximately Rc 48–50. The body 12 is preferably of uniform thickness throughout its length and has planar parallel surfaces 14 and 16 which, for purposes of illustration, may be termed the upper and lower surfaces, respectively, of the wrench device when considered in plan view as in FIG. 1. It will be understood that the terms "upper" and "lower" are only for purposes of illustration, it being recognized that different orientations of the wrench device will occur which will change what then comprises the upper or lower surfaces or ends.

In the illustrated embodiment, the elongated body 12 has a longitudinal length of approximately 7 inches and an overall lateral width of approximately 2.5 inches, thereby providing a relatively convenient size wrench for storage in an automobile glove compartment or other readily accessible storage area in an automobile, truck or motorcycle and the like. The elongated body 12 of the wrench device 10 has substantially identical shaped end portions **12*a* and 12*b* each of which comprises approximately one-half the longitudinal length of the wrench body. Each end portion 12*a* and 12*b* has a generally rectilinear longitudinal axis, identified by lines 20 and 22, respectively, which are generally equally laterally offset from and parallel to a central longitudinal axis of the wrench body as represented by the line 24. Each end portion 12*a* and 12*b* has a plurality of polygonal shaped wrench openings therethrough, as indicated at 28*a–h* in the end portion 12*a*, and at 30*a–h* in the end portion 12*b*. Each of the polygonal shaped wrench openings or through-holes 28*a–h* and 30*a–h*** preferably comprises a 12 point wrench opening so as to enable cooperative relation with square, hexagonal and/or octagonal shaped screw heads, bolt heads and/or nuts.

The wrench openings **28*a–h* are preferably sized to cooperate with metric size screw heads, bolts and nuts, while the wrench openings 30*a–h* are sized for cooperation with American size screw heads, bolts and nuts. The wrench openings 28*a–h* and 30*a–h* in the end portions 12*a* and 12*b* increase progressively in their mean diameter from the smaller wrench openings located generally adjacent the longitudinal center or mid-length of the wrench body, to the larger size wrench openings so that the largest size wrench openings 28*h* and 30*h*** are preferably adjacent the opposite ends of the wrench body. Such positioning of the wrench openings enables the wrench to be gripped in a manner to create a greater moment arm, and thereby greater torque application, when the wrench is used with larger size screws and bolts which theoretically would be used in higher torque applications and require relatively larger torque in tightening or loosening them.

In accordance with one feature of the wrench device 10, each of the opposite end portions **12*a* and 12*b* of the wrench body defines a convenient finger grip along one marginal edge, such as represented by the serpentine or sine-wave like edge surfaces 32 and 34, respectively. Each edge surface 32 and 34 has a plurality of concave finger recesses 32***a* and 34*a*, respectively, with intermediate convex curvature surfaces 32*b* and 34*b* so as to define finger gripping edge surfaces on both ends of the wrench body. The marginal edge of each end portion 12*a* and 12*b* opposite the finger gripping edges 32 and 34 is defined by a generally rectilinear edge surface, indicated at 36*a* and 36*b*, respectively, which lies generally on the longitudinal center axis 24 of the wrench body. Each offset end portion 12*a* and 12*b* of the wrench body has a generally concave edge surface area, indicated at 38*a* and 38*b*, which merges with the rectilinear edge surface 36*a* or 36*b* on the opposite end portion. Each of the concave edge surfaces 38*a* and 38*b* provides a reference surface to facilitate placement of the sole of the operator's shoe against either of the rectilinear edges 36*a* and 36*b* when it is necessary to obtain higher torque in applying or removing a screw or nut than can be obtained with hand gripping of the wrench.

In operation, one using the wrench device 10 mates the appropriate size wrench opening with a polygonal shaped screw head, bolt or nut to be tightened or released by positioning the wrench so that the screw head, bolt or nut is received within the appropriate size wrench opening. Depending upon the orientation of the longitudinal axis of the screw, bolt or nut to be tightened or loosened, and depending upon the resulting orientation of the wrench, the operator may grip both ends 12*a* and 12*b* of the wrench with the operator's hands and effect desired torquing. If one of the larger wrench openings, such as 28*h* or 30*h* is to be used, the operator may utilize one or both hands to grip the opposite end of the wrench and create a larger moment arm with resulting greater torque.

Alternatively, if the wrench in its operating position requires greater torquing force than can generally be obtained by hand gripping the wrench body, the operator may apply the sole of his shoe against the exposed edge surface 36*a* or 36*b* which is spaced farthest from the screw or nut head and thereby apply greater torque to the wrench. It will be understood that rotating the wrench body 12 180° about its longitudinal axis will re-orient the finger gripping and foot receiving edges of the end portions so as to enable the proper torque direction to be effected.

Thus, it will be seen that the present invention provides a relatively inexpensive and highly efficient single wrench device for use with a plurality of different size polygonal shaped American or metric size screw heads, bolts and nuts and which is relatively compact and easily storable.

While a preferred embodiment of the present invention has been illustrated and described, it will be understood to those skilled in the art that changes and modifications may be made therein without departing from the invention in its broader aspects. Various features of the invention are defined in the following claims.

What is claimed is:

1. A wrench device comprising an elongated relatively thin profile generally planar body having similarly shaped first and second end portions of substantially equal length and defining hand gripping wrench ends, said end portions having laterally offset generally rectilinear parallel longitudinal axes lying substantially in the plane of said body and each end portion having a plurality of discrete different size wrench openings formed therethrough in spaced relation along its length for cooperation with different size screw heads, bolts or nuts to apply torque thereto.

2. A wrench device as defined in claim 1 wherein said wrench openings have polygonal configurations.

3. A wrench device as defined in claim 2 wherein said polygonal wrench openings comprise twelve point polygons.

4. A wrench device as defined in claim 1 wherein said elongated body has substantially greater lateral width than transverse thickness and has generally planar opposite surfaces.

5. A wrench device as defined in claim 1 wherein said hand gripping wrench ends are defined by generally serpentine shaped finger gripping edge surfaces for receiving an operator's fingers.

6. A wrench device comprising an elongated generally planar body having similarly shaped first and second end portions of substantially equal length and defining hand gripping wrench ends, said end portions having laterally offset coplanar generally rectilinear parallel longitudinal axes and having a plurality of different size wrench openings formed along the lengths thereof for cooperation with different size screw heads, bolts and nuts to apply torque thereto, each end portion of said wrench body having a generally serpentine shaped finger gripping edge surface for receiving an operator's fingers and having a generally rectilinear edge surface disposed generally laterally opposite the finger gripping edge surface to facilitate application of an operator's foot against the corresponding rectilinear edge surface in applying torque to a screw head, bolt or nut.

7. A wrench comprising an elongated relatively thin profile generally planar body having first and second end portions of substantially equal length and defining hand gripping wrench ends, said end portions having laterally offset coplanar generally rectilinear parallel longitudinal axes and having a plurality of different size wrench openings formed along the lengths thereof enabling cooperation with different size screw heads, bolts and nuts to apply torque thereto, said end portions of said elongated body being substantially similar in shape and each having a plurality of said wrench openings of different size progressing from a wrench opening of smaller size generally adjacent the mid-length of the elongated body, and progressing to a wrench opening of largest size adjacent an outermost end of the end portion.

8. A wrench device as defined in claim 7 wherein a selected one of said end portions of said elongated body has its said wrench openings sized for cooperation with screw heads, bolts and nuts of American standard sizes, and said wrench openings in the opposite end portion are sized for cooperation with screw heads, bolts and nuts of metric size.

* * * * *